United States Patent [19]

Alley et al.

[11] Patent Number: 4,663,569

[45] Date of Patent: May 5, 1987

[54] ENERGY MANAGEMENT/DIMMING SYSTEM AND CONTROL

[75] Inventors: Robert P. Alley, Clifton Park; William H. Bicknell, Ballston Lake; Kevin C. Routh, Schenectady, all of N.Y.

[73] Assignee: General Electric Company, Schenectady, N.Y.

[21] Appl. No.: 780,548

[22] Filed: Sep. 26, 1985

[51] Int. Cl.[4] ..... H05B 37/00

[52] U.S. Cl. ..... 315/175; 315/176; 315/194; 315/199; 315/DIG. 4

[58] Field of Search ..... 315/175, 176, DIG. 4, 315/194, 199

[56] References Cited

U.S. PATENT DOCUMENTS

| | | | |
|---|---|---|---|
| 4,350,935 | 9/1982 | Spira et al. | 315/291 |
| 4,392,086 | 7/1983 | Ide et al. | 315/199 |
| 4,482,844 | 11/1984 | Schweer et al. | 315/194 |
| 4,527,099 | 7/1982 | Capewell et al. | 315/291 |
| 4,604,552 | 8/1986 | Alley | 315/176 |

*Primary Examiner*—Harold Dixon

*Attorney, Agent, or Firm*—Marvin Snyder; James C. Davis, Jr.

[57] ABSTRACT

A fluorescent lamp dimming system which can be used in a retrofit manner with existing fluorescent lamp ballasts achieves a greater degree of energy management than has been previously possible. A dimming control having closed-loop feedback uses integrals of current as a measure of light output from the fluorescent lamps. The electronic control circuit implements complex control methods in a minimal space and at a minimal cost.

39 Claims, 12 Drawing Figures

ENERGY MANAGEMENT/DIMMING SYSTEM AND CONTROL

The present application is related to U.S. application Ser. No. 780,143, entitled "Adjusting Feedback Gain in a Fluorescent Lamp Dimming Control", Alley et al., and to U.S. application Ser. No. 780,142, entitled "Wall Box Fluorescent Lamp Dimmer", Alley et al., both filed of even date and assigned to the assignee of the present application, and both of which are incorporated by reference.

BACKGROUND OF THE INVENTION

The present invention relates in general to retrofit fluorescent lamp dimming and more specifically to a closed-loop electronic dimming control and to a control method for a fluorescent lamp dimming system.

Historically, the realization of a dimmable fluorescent lighting system which is inexpensive and convenient to install and use has been very elusive. The vast majority of fluorescent lighting units in use are, consequently, of the nondimming type, most using filament-heated lamps and the rapid-start type of ballast. However, these units tend to be application inefficient since they often produce more light and consume more energy than required in a particular situation.

Fluorescent lamp dimmers are known which are capable of dimming the light output of fluorescent lamps connected in conventional ballasts by conditioning the AC power supplied to the ballast, and which are retrofitable. In one exemplary prior art device, such as is shown in U.S. Pat. No. 4,350,935 to Spira et al., a portion or portions are removed from each half-cycle of the AC input waveform (by opening a switch in series with the lamp ballast and power supply) resulting in periods of zero energy transfer to the lamps. The overall reduction in energy transfer results in a lowered light output from the lamps.

An improved fluorescent lamp dimming system of the prior art conditions the AC power supplied to the lighting system by chopping the input waveform in order to provide a variable duty cycle, low frequency input component which gives a variable light output, and to provide a high frequency component (at least 10 times greater than line frequency) for maintaining filament heating at any amount of dimming without adding substantially to the light output. This improved system is described in U.S. patent application Ser. No. 645,593 of Alley et al., filed Aug. 30, 1984, which is of common assignment and which is hereby incorporated by reference.

Fluctuations in line voltage supplied to a lighting system can cause undesirable changes in total light output. It would be advantageous to stabilize light output over a wide range of operating conditions, including sizes of the load connected to the dimming system.

A dimming control product must be loss-less or have very low losses in order to maximize the energy savings of dimming. Not only should the dimming system maintain a correct average light level, but it should also not be subject to lamp flicker from DC offset voltages.

Accordingly, it is a principal object of the present invention to provide an electronic control and a control method for dimming fluorescent lamps.

It is another object of the invention to provide closed-loop feedback in a fluorescent lamp energy management/dimming system.

It is a further object of the invention to provide a fluorescent lamp dimming system which is insensitive to voltage fluctuations and DC offsets.

It is yet another object of the invention to provide a dimming system of low energy consumption and low cost, which is also retrofitable.

SUMMARY OF THE INVENTION

These and other objects are achieved by a method of the present invention for operating a dimming system connected to a fluorescent lighting system including a ballast, fluorescent lamps and an AC source. The dimming system includes a switch connected in series with the ballast, and a dimming control circuit for controlling the switch in response to a level command to provide a notch period in each half-cycle of the current supplied to the ballast by the AC source. The method comprises the steps of (1) taking a plurality of current measurements, each measurement representing at least a portion of the current flowing to the ballast during a predetermined time period; (2) averaging the plurality of measurements; (3) calculating the error between the average and a command current reference corresponding to the level command; and (4) altering the notch period to reduce the error.

The invention also provides a dimming control circuit for using in a fluorescent lamp dimming system, the dimming system being adapted to be connected to a fluorescent lighting system including a ballast, fluorescent lamps and an AC source. The dimming system includes a switch for connecting in series with the ballast. The switch is adapted to turn on and off at a high frequency during a notch period within each half-cycle of current supplied to the ballast by the AC source, and also adapted to turn on during the portions of each half-cycle outside of the notch period. The dimming control circuit comprises signal processing means, integrating means, comparing means, timing means and logic means.

The signal processing means is adapted to be coupled to the switch. It provides a first output signal proportional to the instantaneous current flowing through the switch and a second output signal indicating zero crossings of the current.

The integrating means is coupled to the signal processing means for integrating the first output signal to provide a current integral. The timing of the integration is provided according to the second output signal of the signal processing means. The comparing means is coupled to the integrating means and compares the current integral to a command current reference to provide an error value.

The timing means is coupled to the signal processing means in order to receive the second output signal. It is also adapted to be coupled to the switch. The timing means includes digital counters for establishing the notch period and the high frequency switching of the switch during the notch period.

The logic means is coupled to the signal processing means, the comparing means and the timing means, and is adapted to receive a light level command signal. The logic means provides the command current reference to the comparison means based on the light level command signal. It also provides counting values to the digital counters based on the command current reference and the error value.

In another aspect of the invention, a fluorescent lamp dimming system comprises microprocessor means, a data bus and an address bus connected to the microprocessor means, a timing controller and interface means. The microprocessor means controls the operation of the dimming system and includes a clock, a stored program and data memory. It is responsive to an interrupt. The timing controller is connected to the data bus and to the address bus, is coupled to the microprocessor means, and includes first and second digital counters. The first digital counter is adapted to generate a notch period. The second digital counter is adapted to generate high frequency pulses during the notch period. The counters are loaded by the microprocessor means. The interface means is connected to the microprocessor means for receiving an externally supplied light level command and for providing the command to the microprocessor means.

BRIEF DESCRIPTION OF THE DRAWINGS

The novel features of the invention are set forth with particularity in the appended claims. The invention itself, however, as to organization and method of operation, together with further objects and advantages thereof, may best be understood by reference to the following description taken in conjunction with the accompanying drawings in which:

DETAILED DESCRIPTION OF THE INVENTION

Figure 1:
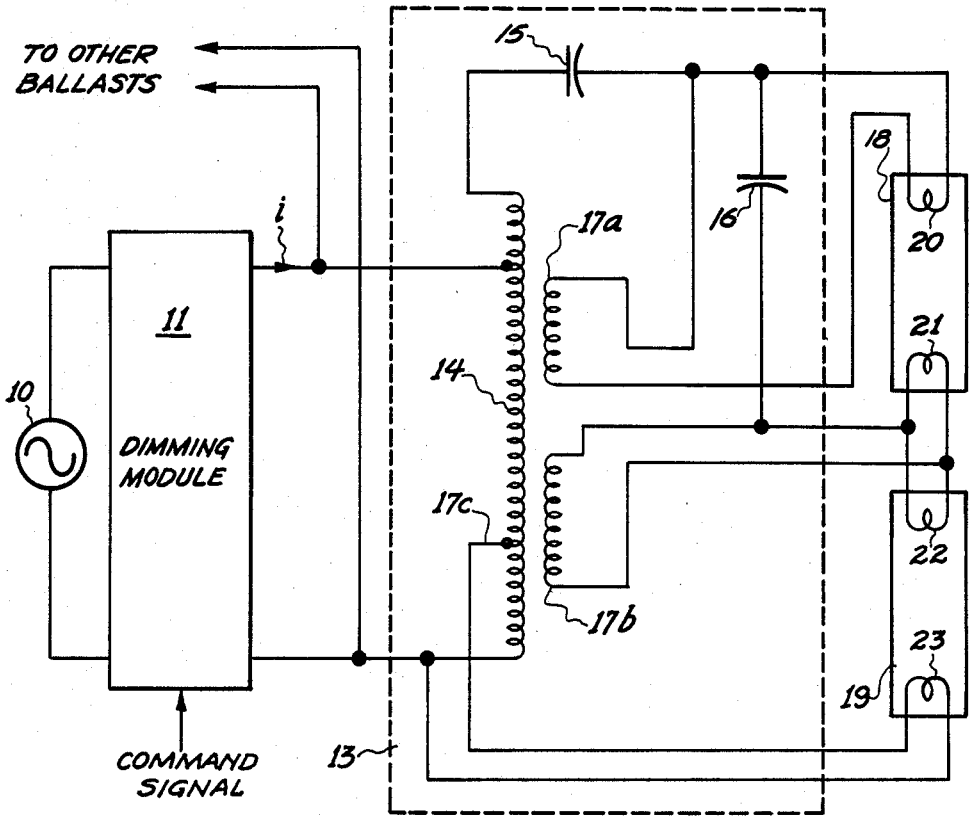
FIG. 1 is a part schematic, part block diagram of a fluorescent lighting system with a dimming module connected thereto, according to the instant invention.

Referring now to the drawings, FIG. 1 is a schematic diagram of a fluorescent dimming system for utilizing the present invention. A dimming module 11, for providing dimming in response to a command signal, is connected between an AC source 10, typically a 60 hertz power line from a distribution panel, and a conventional nondimming rapid-start fluorescent ballast 13 (an 8G1022W ballast manufactured by the General Electric Company is shown in the Figure). Ballast 13 powers series connected fluorescent lamps 18 and 19 and filament heaters 20–23 of lamps 18 and 19. Ballast 13 includes autotransformer 14, power factor correcting capacitor 15, starting capacitor 16 and filament secondaries 17*a*, 17*b* and 17*c*.

Figure 2:
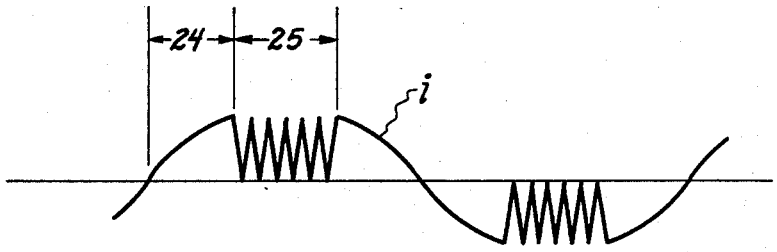
FIG. 2 is a waveform diagram of the current supplied by the dimming system during dimming.

In previously mentioned application Ser. No. 645,593, it was disclosed that lamps 18 and 19 may be dimmed by lowering the duty cycle of the low frequency AC line voltage during each half-cycle of line voltage and adding a high frequency component to the ballast voltage either continuously or during the off portions of the low frequency component in order to maintain filament heating. In the present invention, dimming module 11 performs this function except that a current reference is substituted for the voltage reference for compatibility with the wall box dimmer described in application Ser. No. 780,142 and for allowing current to be used as a feedback variable. Thus, the input current waveform is chopped by dimming module 11 as shown in FIG. 2. A notch delay period 24 is measured from a zero crossing of the current waveform i to the beginning of a notch period 25. Current is chopped during notch period 25 to produce a series of high frequency pulses which provide power to filaments 20–23 of FIG. 1, but which make very little contribution to the light output of lamps 18 and 19. By varying the length of notch delay 24 and the width of notch period 25, a variable light output from lamps 18 and 19 results. The frequency of the high frequency pulses is preferably at least 10 times greater than the frequency of source 10.

Figure 3:
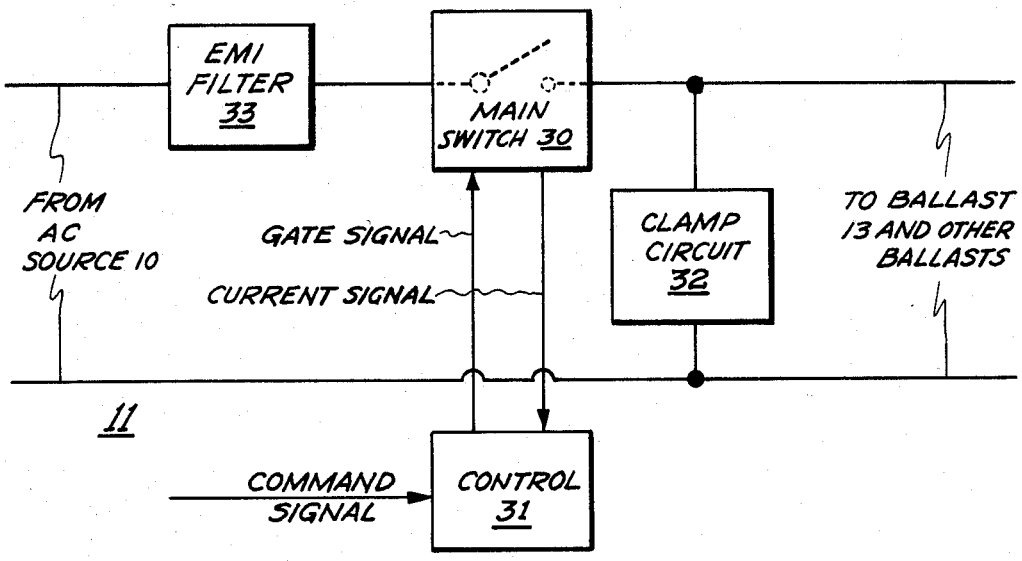
FIG. 3 is a block diagram showing the dimming module of FIG. 1 in greater detail.

One possible configuration of dimming module 11 for conditioning current i to obtain the waveform of FIG. 2 is shown in FIG. 3. A main switch 30 is connected in series with the ballast(s) and is adapted to be turned on when the lamps are on except during the notch periods when main switch 30 chops the ballast current at a high frequency. Control 31 controls the conduction of main switch 30 via a gate signal in response to a command signal, typically supplied from a remote location, and in response to a current signal fed back from main switch 30. A clamp circuit 32 is connected in parallel with the ballasts to limit the voltage across the ballasts which could otherwise rise to extremely high levels during rapid switching of the current supplied to the inductive ballast load by main switch 30. Examples of clamp circuit 32 are disclosed in U.S. patent application Ser. No. 677,413 of Alley et al., filed Dec. 3, 1984, entitled "Active Clamp Circuit" which is also of common assignment. An electromagnetic interference (EMI) filter 33 is connected between main switch 30 and AC source 10 to reduce electromagnetic interference propagating from dimming module 11.

Figure 4:
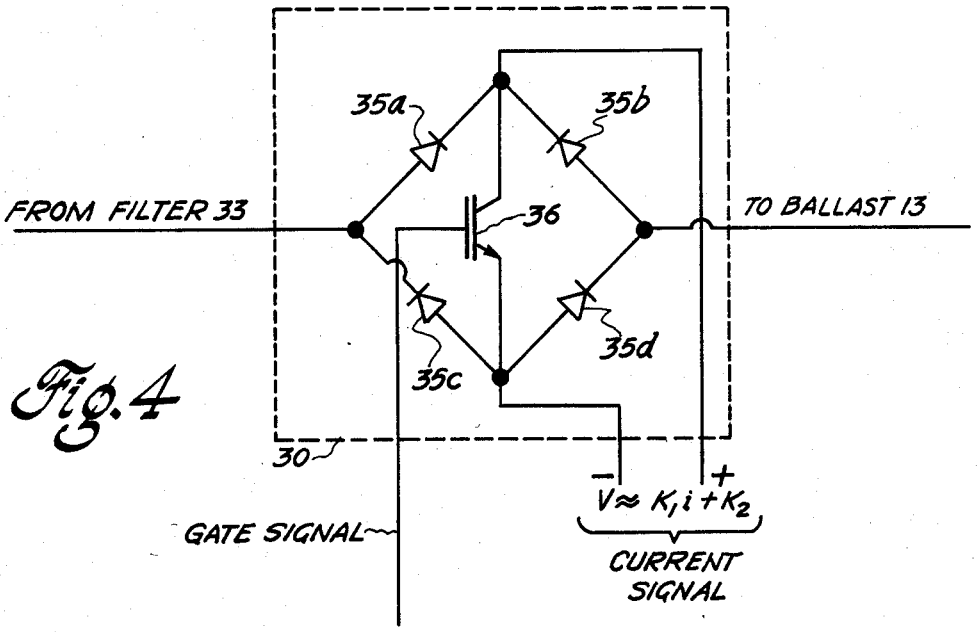
FIG. 4 is a schematic diagram of main switch 30 of FIG. 3.

Turning now to FIG. 4, a preferred embodiment of main switch 30 is seen to include a diode-bridge rectifier comprising diodes 35*a*–35*d*. The input terminals of the diode bridge are connected to the AC line between AC source 10 and ballast 13. A semiconductor switch 36 is connected to the output terminals of the diode rectifier. The control electrode of switch 36 receives the gate signal from control 31. Switch 36 is shown in the Figure as an insulated gate transistor (IGT) which is available from the General Electric Company Semiconductor Business Division, Syracuse, N.Y. The IGT is a preferred semiconductor device for switch 36 for the reason that the relationship between the voltage drop across it and the current flowing through it is fairly consistent for all such devices. Furthermore, the voltage drop across the device is a reliable measure of the current flowing through it (i.e. the ballast input current) and has the general form $V=K_1i+K_2$. Other field-effect devices which exhibit the same type of relationship may alternatively be used. It is also possible, alternatively, to use a device for switch 36 which does not exhibit this relationship if a current transformer, a shunt or other means is used to measure the current.

Figure 5:
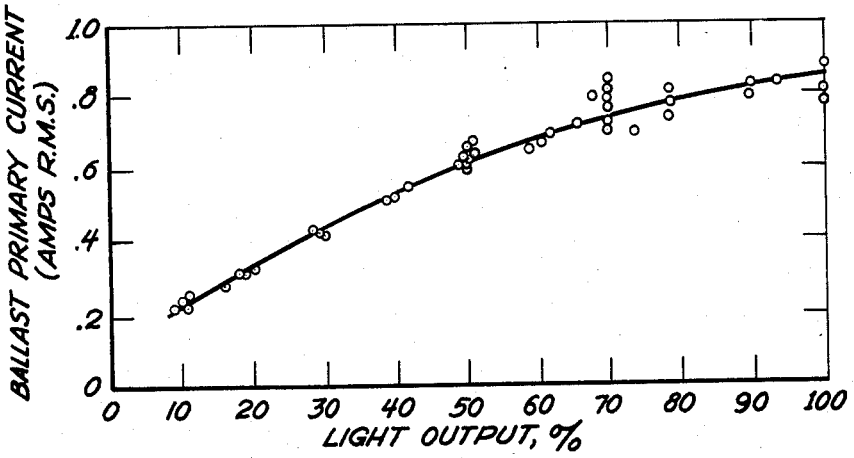
FIG. 5 is a typical plot of light output versus ballast input current for a fluorescent lighting system.

The significance of easily obtained current measurements will become apparent from an examination of FIG. 5 which is a plot of light output from a filament-heated fluorescent lamp for different values of ballast input current to the conventional rapid-start ballast connected to the lamp. The relationship is fairly linear throughout the dimming range of 10% to 100%, thus making ballast input current an acceptable control variable to be regulated by control 31 of FIG. 3. By taking the integral of the input current, the effects of noise on the current measurements can be reduced.

In view of the above, the present invention contemplates a fluorescent dimming system wherein the integral of current flowing to the ballast primary is the controlled variable. Further noise immunity is achieved by averaging a plurality of current measurements and determining the error between the average and a command current reference corresponding to the level command signal. The amount of error is used to alter the location and duration of the notch period so as to achieve the desired current integral. Preferably each current integral is taken over a half-cycle, and four consecutive half-cycles are used for obtaining the average. Since the high frequency pulses which are input to the ballast during the notch period make essentially no contribution to light output, the integral is taken only outside of the notch periods.

It is further contemplated that the dimming control of the invention perform the steps of (1) finding the difference between the latest command current reference used in the control and the reference which corresponds to the discrete level command signal; (2) comparing the difference to a constant representing a step size which is less than the step between adjacent level command signals; and (3) modifying the command current reference by the smaller of the constant and the difference. These steps cause the light output of the lamps to ramp between discrete light output commands when the command is changed.

In order to avoid the appearance of flicker, consecutive half-cycles of current should generate a substantially equal amount of light. Therefore, it is highly preferable that the notch period in successive half-cycles be substantially identical (except when light output is ramping between light levels). However, by obtaining the timing of the notch period from the zero crossings of the input current waveform, the system becomes sensitive to any DC offset in the waveform because this will cause consecutive half-cycles of unequal duration and incorrect timing of the notch periods. This problem is solved according to the present invention by sensing alternate zero crossings to obtain the timing of each full-cycle. A counter is used for electronically counting from the alternate zero crossings to determine the midpoints (i.e. half-cycles) between the sensed zero crossings. Thus, each notch period is accurately placed in each control half-cycle.

A further feature of the invention relates to passing the current error through an error filter which performs a damping function on the system response. Since the error is being calculated in the present invention in a digital form, the error is digitally filtered relative to the previous alteration in the notch period. The digital error filtering function may have the general form $$(A \cdot D) + (B \cdot E) = D', \text{ where}$$

D is the previous alteration in the notch period;

E is the error;

D′ is the new notch period alteration; and

A and B are gain values whose sum is unity.

In a preferred embodiment, A has a value of 0.75 and B a value of 0.25.

Figure 6:
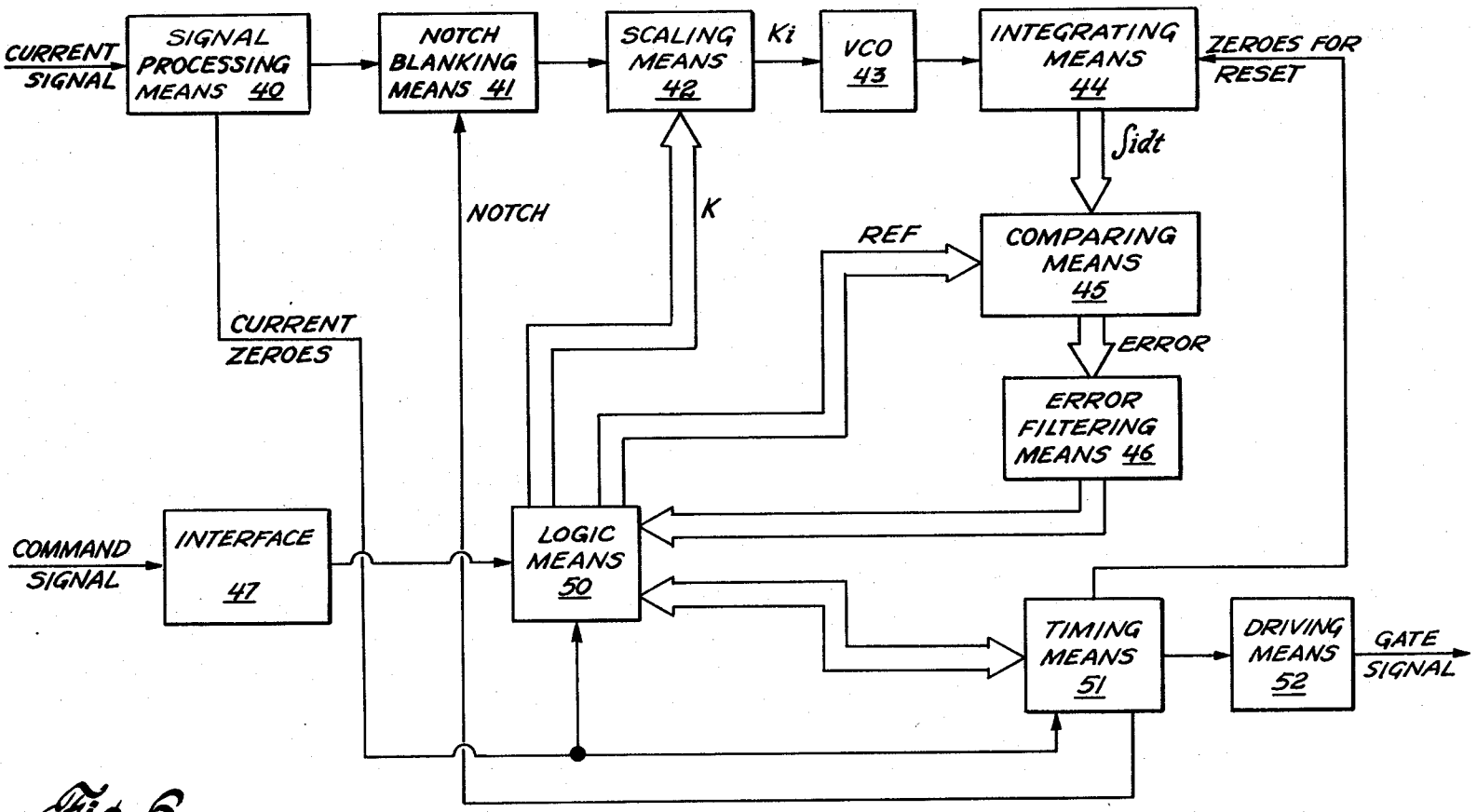
FIG. 6 is a functional block diagram of the dimming control block 31 of FIG. 3.

Referring now to the functional block diagram of FIG. 6, control block 31 of FIG. 3 is shown in greater detail. FIG. 6 shows a current feedback path comprised of serially connected signal processing means 40, notch blanking means 41, scaling means 42, voltage-controlled oscillator (VCO) 43, integrating means 44, comparing means 45 and error filtering means 46. Current control is achieved by interface 47, logic means 50, timing means 51 and driving means 52.

Signal processing means 40 receives the current signal from the main switch and has two output signals. A first output signal is proportional to the instantaneous current flowing through the main switch. A second output signal indicates zero crossings of the low frequency component of the instantaneous main switch current by a short output pulse at each detected zero crossing.

The first output signal of signal processing means 40 is input to notch blanking means 41. The feedback of current as a measure of light output should not include the high frequency current present during the notch periods, since that current makes essentially no contribution to light output. Thus, notch blanking means 41 outputs a zero value during the notch periods, and may comprise, for example, a transistor controlled by a notch signal. Outside of the notch periods, the first output signal of signal processing means 40 is passed through notch blanking means 41 to scaling means 42. The output signal of scaling means 42 equals the output signal of notch blanking means 41 multiplied by a factor K which is supplied by logic means 50. The scaled current signal Ki is supplied to VCO 43 which has its output coupled to integrating means 44. The output signal of VCO 43 has a frequency proportional to the magnitude of the scaled current. Integrating means 44 is comprised of a digital counter which counts the number of pulses (or cycles) in the VCO output signal between zero crossings. The result is a current integral for a half-cycle representing the light produced during that half-cycle. Notch blanking means 41 may alternatively be located between VCO 43 and integrating means 44.

Current zeroes for resetting the count of integrating means 44 are obtained from the second output signal of processing means 40 which is provided to timing means 51. Timing means 51 performs a timing function which generates midpoint zeroes (i.e. psuedo-zero crossings) between alternate zero crossings detected by signal processing means 40. A signal formed by combining the alternate sensed zeroes and the timed zeroes is provided to integrating means 44 for timing each half-cycle current integral.

A command signal is coupled to logic means 50 via interface 47. Logic means 50 determines the command current reference corresponding to the commanded light level, and loads that reference into comparing means 45 where it will be compared to a current integral. The error between the current integral and the command current reference is transmitted to error filtering means 46. The filtered error is transmitted to logic means 50.

Timing means 51 is comprised of digital counters for establishing the location and duration of each notch period and for generating a high frequency switching signal during each notch period. The output signals of these digital counters are coupled to driving means 52 which generates a gate signal which has a high logic level outside of the notch periods and which comprises high frequency pulses within the notch periods. The gate signal is coupled to the main switch.

The counting values used by timing means 51 are under control of logic means 50. If logic means 50 determines that an error exists between the command current reference and the latest current integral, then these counting values are altered so as to reduce the error (e.g. the filtered error).

Comparing means 45 preferably averages four consecutive half-cycle current integrals before each comparison is made. It is also preferred that logic means 50 impose a maximum step size in the alterations of the counting values (i.e. notch period) to cause a ramping effect when the command signal changes from one discrete lighting level to another.

Figure 7:
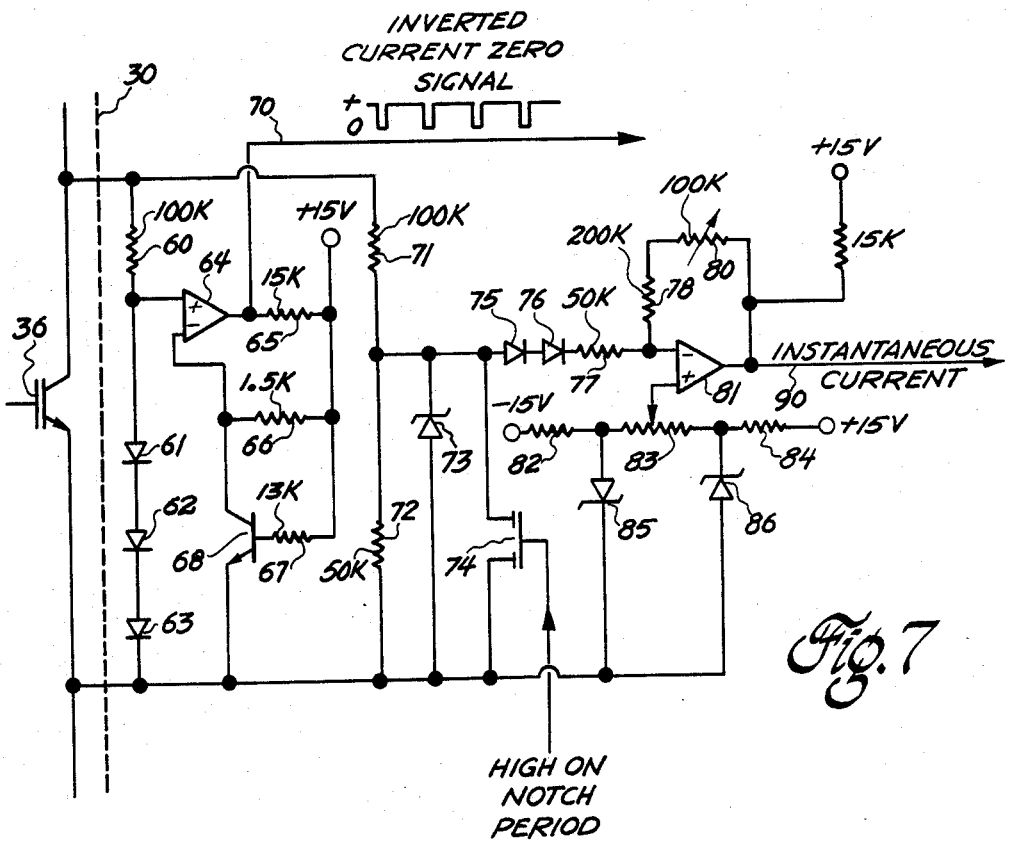
FIG. 7 is a schematic diagram of a portion of the dimming control including the signal processing means of the invention.
Figure 8:
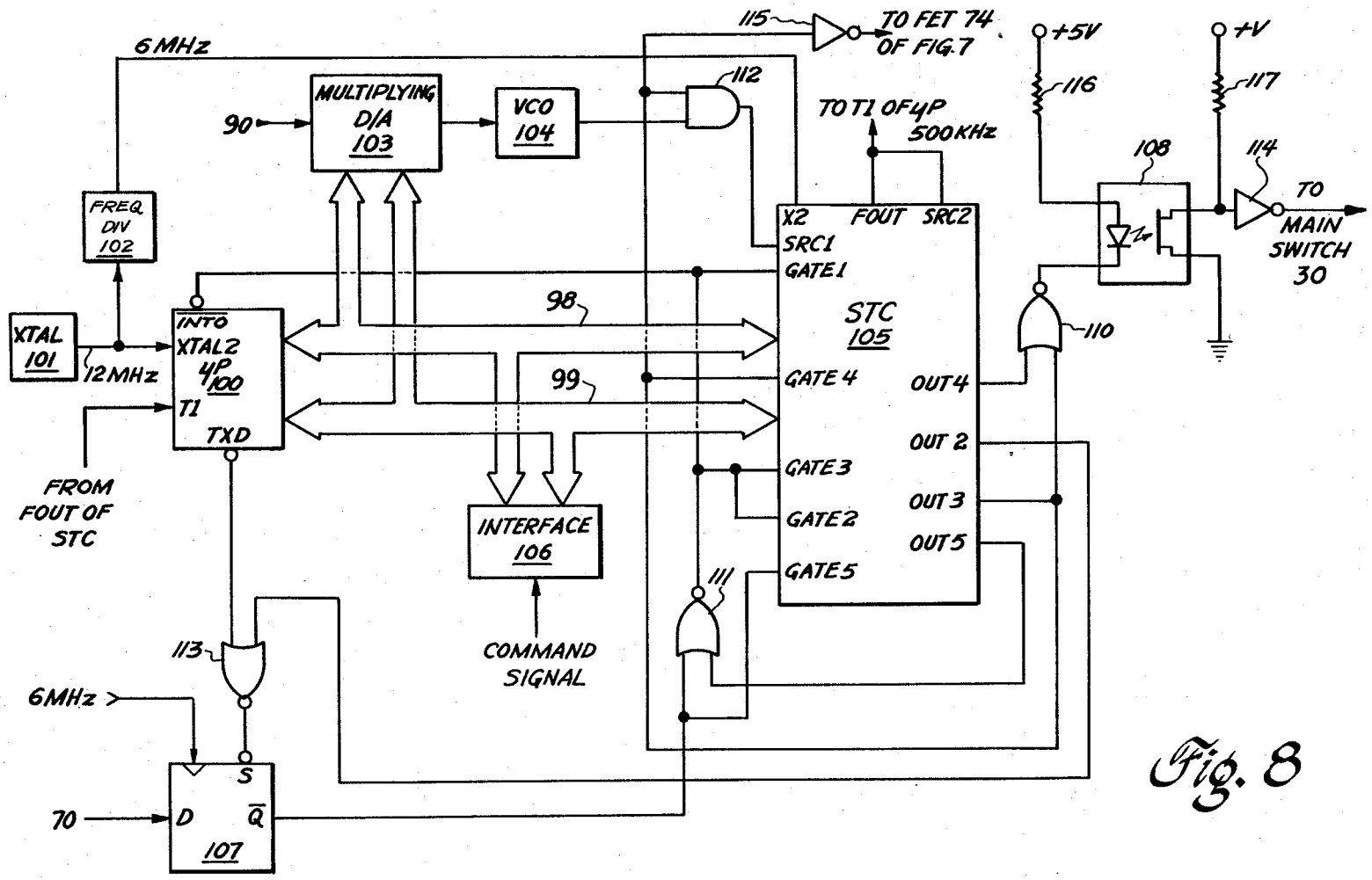
FIG. 8 is a schematic diagram of the remaining portion of the dimming control of FIG. 7 and of the driving means of the invention.

Referring now to FIGS. 7 and 8, specific hardware circuitry for implementing the present invention will be described. FIG. 7 shows the signal processing circuit 40 of FIG. 6, which is connected to the main switch, for generating a signal proportional to instantaneous current through the main switch and a signal indicating current zeroes. A resistor 60 and three diodes 61–63 are connected in series across IGT 36 of main switch 30. The junction between resistor 60 and diode 61 is connected to the noninverting input of a comparator 64. The comparator output is coupled to a DC supply, such as 15 volts, through a resistor 65. The inverting input of comparator 64 is coupled to the 15 volt DC supply through a resistor 66. A resistor 67 has one end connected to the 15 volt supply and the other end connected to the base of a transistor 68. The collector of transistor 68 is connected to the inverting input of comparator 64 and the emitter of transistor 68 is connected to the cathode of diode 63. The output of comparator 64 is connected to a line 70 for providing an inverted current zero output signal. In operation, comparator 64 monitors the current in IGT 36 through a voltage divider comprised of resistor 60 and diodes 61–63. When the voltage drop across IGT 36 falls to the reference value (in the range of 0.2 to 0.3 volts) the output voltage of the comparator briefly falls to a low level.

A series connected pair of resistors 71 and 72 is also connected across IGT 36. A zener diode 73 and a field effect transistor (FET) 74 each are connected in parallel with resistor 72. The gate of FET 74 is connected to receive a signal which is high during each notch period as will be described hereinafter. The inverting input of a comparator 81 is coupled to the junction between resistors 71 and 72 through diode 75, diode 76 and resistor 77. The inverting input of comparator 81 is coupled to the output of comparator 81 through a resistor 78 and a potentiometer 80 for negative feedback. The noninverting input of comparator 81 is connected to the tap of a potentiometer 83 for supplying a voltage reference. One side of potentiometer 83 is coupled to a DC supply, such as −15 volts, through a resistor 82. The other side of potentiometer 83 is coupled to a DC supply, such as +15 volts, through a resistor 84. The junction between resistor 82 and potentiometer 83 is connected to the anode of a zener diode 85 and the cathode of zener diode 85 is connected to the emitter of IGT 36. The junction between potentiometer 83 and resistor 84 is connected to the cathode of a zener diode 86 and the anode of zener diode 86 is connected to the emitter of IGT 36. The output of comparator 81 is coupled to a +15 volt supply through a resistor 79 and is connected to a line 90 for providing an instantaneous current output signal. This portion of signal processing means 40 also monitors the voltage drop across IGT 36. For the IGT used in the present embodiment, the expected voltage drop across IGT 36 was approximately 0.5 volts+(0.12 volts per ampere of switch current). The resistance values shown in FIG. 7 were selected so that the voltage divider connected to the inverting input of comparator 81 delivers 4 volts when peak current is flowing in IGT 36. In operation, this portion of the circuit acts as an inverting buffer with a gain of at least about 4.

A signal which is high during each notch period is coupled to the gate of FET 74 which is a clamping FET for the circuit input. Thus, FET 74 prevents voltage spikes at the circuit input which are generated when IGT 36 is opened.

Turning now to FIG. 8, the remainder of control circuit 31 is seen to have two major components, a microprocessor 100 and a system timing controller (STC) 105. In the embodiment being described, microprocessor 100 may comprise an 8751 microprocessor manufactured by Intel Corporation and STC 105 may comprise an AM9513 system timing controller manufactured by Advanced Micro Devices Inc. Microprocessor 100 and STC 105 are interconnected by a data bus 98 and an address bus 99. Demultiplexers, bus drivers and decoders for connecting various components to data bus 98 and address bus 99 are not shown since their use is well within the ordinary skill in the art.

The Intel 8751 microprocessor used in the present invention contains 256 bytes of random access memory (RAM), 4K bytes of erasable programmable read only memory (EPROM), two software configurable counter/timers and four 8-bit ports. Microprocessor 100 accesses external devices using addresses which will be provided after the external devices are described.

The AM9513 system timing controller used in the present invention contains five 16-bit software configurable counter/timers and a software configurable frequency divider. Each counter/timer includes three 16-bit registers, namely the mode, load and hold registers. The load and hold registers store data for the counting cycles while the mode register determines the operation of the counter/timer.

The AM9513 system timing controller also includes a master mode register which configures the internal frequency divider. The contents of this register determine the frequency source for the frequency divider as well as the factor for dividing the source frequency.

A crystal 101 provides a signal, preferably 12 megahertz, to the XTAL2 input of microprocessor 100. A frequency divider 102 also receives the 12 megahertz signal which it divides by 2 to produce a 6 megahertz signal. The 6 megahertz signal is provided to the X2 input of STC 105. The master mode register of STC 105 is configured such that input X2 is the frequency source for the frequency divider and the source frequency is divided by 12 to provide a 500 kilohertz signal at output FOUT. The 500 kilohertz signal is provided to input SRC2 of STC 105 and to input T1 of microprocessor 100. A SRC2 input of STC 105 is used to provide the count source for the various timing functions of STC 105 relating to the notch period and current zero calculations.

Counter/timer #1 is used as the current integral counter. Line 90 of the signal processing circuit of FIG. 7 is connected to a multiplying digital-to-analog (D/A) converter 103 which scales the instantaneous current signal in accordance with a scale factor loaded by microprocessor 100 as more fully described in concurrently filed application Ser. No. 780,143. The analog output of multiplying D/A 103 is coupled to VCO 104. The output of VCO 104 is connected to one input of a two-input AND gate 112 which comprises the notch blanking means of the present invention. The other input of AND gate 112 is connected to receive a notch signal as will be described below. The output of AND gate 112 is connected to the SRCl input of STC 105 which is selected as the count source for counter/timer #1. Counter/timer #1 is configured as a retriggerable one shot (mode R) such that each counting cycle is gated by the input at GATE1. On a falling edge of the signal to GATE1, the counter is stopped and its contents transferred to the hold register and then the value stored in the load register is transferred to the counter. The load register is initialized with a value of zero so that counting restarts from zero at each half-cycle. Thus, counter/timer #1 counts the number of pulses in the output from VCO 104 between current zero signals received at the GATEI input. The latest count is stored in the hold register which may accessed by microprocessor 100 through data bus 98 and address bus 99.

Counter/timer #2 of STC 105 generates a current zero enable signal which is used to select alternate current zeroes detected by the signal processing circuit of FIG. 7 and also to prevent the detection of false current zeroes. Associated with this function of counter/timer #2 are a D-type flip-flop 107 and a NOR gate 113. Line 70 from the signal processing circuit of FIG. 7 (which carries a signal which is high except during current zeroes) is connected to the D input of flip-flop 107. The 6 megahertz signal from frequency divider 102 is connected to the clock input of flip-flop 107. The output of NOR gate 113 is connected to the not S input of flip-flop 107. The not Q output of flip-flop 107 is used to provide an output signal which has a high going transition on alternate current zeroes detected on line 70.

Whenever the output of NOR gate 113 is low, flip-flop 107 is set, thus forcing its not Q output to a low state. The output of NOR gate 113 is low when either of its inputs is high. Thus, a high output from the OUT2 output of STC 105 inhibits flip-flop 107 from detecting a zero crossing. The value stored in the hold register of counter/timer #2 is ICOO in hexadecimal format which causes output OUT2 of STC 105 to be high for a period of 14.35 milliseconds after a current zero is indicated at the GATE2 input of STC 105. At the end of the delay time, the OUT2 output signal of STC 105 goes low causing the output signal of NOR gate 113 to go high, and thus allowing flip-flop 107 to detect a true current zero once per cycle to synchronize the system.

The other input of NOR gate 113 is connected to the TXD output of microprocessor 100. During system initialization, microprocessor 100 forces flip-flop 107 to a set state by generating a high level input to NOR gate 113. After initialization, this input signal to NOR gate 113 is forced low and remains low.

The resulting output signal from the not Q output of flip-flop 107 consists of brief pulses with positive going transitions at alternate current zeros. This signal is coupled to one input of a two-input NOR gate 111 and to the GATE5 input of STC 105. Counter/timer #5 is a pseudo current zero counter which generates an artificial current zero pulse every other half cycle. This counter is configured as a non-retriggerable one shot (mode L) which is active on a positive going edge input to GATE5 and which uses SRC2 as the count source. The count value stored in the load register in the example herein set forth is 1045 hexadecimal which gives a delay of 8.33 milliseconds. On a positive going transition on the GATE5 input, counter/timer #5 counts down the value loaded from the load register. Once this value has been counted down, a high output pulse is supplied from the OUT5 pin of STC 105. The output pulses from OUT5 are 8.33 milliseconds after each zero crossing pulse from flip-flop 107 and are thus at the midpoint between alternate current signals. The OUT5 output of STC 105 is connected to the other input of NOR gate 111. Thus, the output of NOR gate 111 is the complement of a signal indicating evenly spaced zero crossings every 8.33 milliseconds.

The complemented zero crossing signal is coupled to the GATE1, GATE2 and GATE3 inputs of counter/timers #1, #2 and #3, respectively, and also to an interrupt input of microprocessor 100. The microprocessor interrupt causes microprocessor 100 to execute a series of current control routines each half cycle.

Counter/timer #3 of STC 105 is a notch control counter which generates both the notch delay and the notch width of each notch period. This counter is configured as a hardware triggered, delay pulse one shot (mode L) which is active on a low going edge to input GATE3, and which uses SRC2 as a count source. The counter is initialized with a high level at its output OUT3. When a falling edge is detected at GATE3, the counter counts down a value loaded from the load register. When the count reaches zero, OUT3 toggles to a low condition. The counter then reloads from the hold register and the counting resumes. When the value from the hold register has been counted down, OUT3 is toggled to a high level and the counter reloads from the load register but does not continue counting until a new low going edge is received at GATE3.

The count values contained in the load and hold registers of counter/timer #3 are dynamically calculated by the control software. Thus, both the notch position and duration are under control of the feedback loop. OUT3, the output of counter/timer #3, is logically NOR'ed in a NOR gate 110 with a notch frequency signal from OUT4 of counter/timer #4. The OUT3 output signal is also provided to notch blanking AND gate 112 and to inverter 115.

Counter/timer #4 of STC 105 is the notch frequency counter which generates pulses within each notch period. The counter is configured as a rate generator with synchronization (mode Q) which is active on a low signal to GATE4 and which counts on a rising edge of count source SRC2. In this mode of operation, a value loaded from the load register is counted down only when a low level is present at GATE4. When zero is reached, the OUT4 output toggles to the opposite state. The counter then reloads from the load register and restarts the counting process. The output state of counter/timer #4 is initialized by microprocessor 100 to a low level prior to each notch period to insure that the first transition of the output state of the notch frequency counter is independent of what occurred during the previous notch period. The count value stored in the load register of counter/timer #4 is calculated by the control software and is updated accordingly. The nominal count value yields a notch pulse frequency of about 1 kilohertz.

The OUT3 and OUT4 output signals of STC 105 are combined by NOR gate 110 to form the complement of the gate signal to main switch 36. The output of NOR gate 110 is connected to one input of an opto-isolator 108 which provides isolation between the controller voltage and the higher main switch voltage. The other input of opto-isolator 108 is coupled to a +5 volt supply through a resistor 116. One output of opto-isolator 108 is connected to the input of an inverter 114 and is coupled to a DC voltage +V through a resistor 117. The other output of opto-isolator 108 is connected to ground. The output of inverter 114 is connected to IGT 36. Thus, inverter 114 provides a gate signal to IGT 36 and the gate signal is isolated from the logic circuitry of the control.

Turning again to microprocessor 100, it is seen that an input T1 receives a 500 kilohertz signal from the FOUT output of STC 105. The T1 input provides a counting frequency to a counter internal to microprocessor 100 which generates a diagnostic interrupt every 65 milliseconds. Microprocessor 100 executes a diagnostic interrupt service routine which may be used to update the value of a command signal via an interface 106 connected to data bus 98 and address bus 99. The present invention was constructed using hexadecimal switches and displays connected via appropriate decoders and buffers. This allowed either viewing or modification of any data stored in the 256 bytes of RAM within microprocessor 100. However, in a preferred embodiment, interface 106 is comprised of a single buffer for receiving a command signal representing a desired lighting level.

Multiplying D/A 103 was addressed at location OBO, while the data port of STC 105 was located at OFO and the command port of STC 105 was located at OF1. These low memory locations enabled quick access by microprocessor 100 by making special use of the MOVX instruction.

Figure 9:
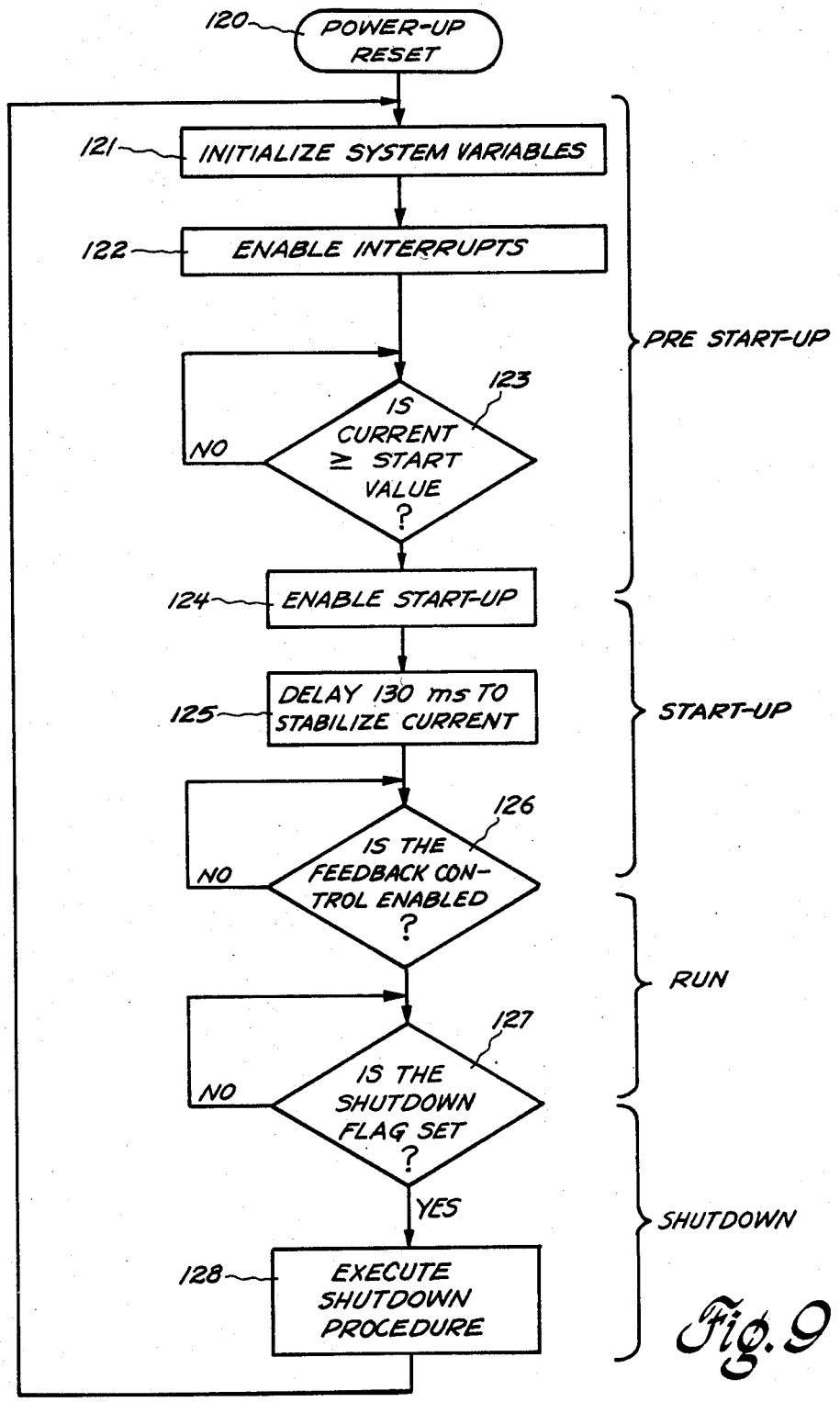
FIG. 9 is a flow diagram of the executive control sequence used by the microprocessor of FIG. 8.

Turning now more particularly to the operation of microprocessor 100, a flow diagram of the executive control sequence is shown in FIG. 9. At steps 120 and 121, the power-up reset and initialization of system variables occurs. At step 122 interrupts are enabled. At step 123 a loop is performed until input current to the ballast is greater than or equal to a starting value. In step 124 the start-up routine is enabled. Step 125 is comprised of a 130 millisecond delay during which input current to the ballast is stabilized. A loop is performed at step 126 until the feedback control routine is enabled. At step 127 a loop is performed until a shutdown flag is set. During the looping of step 127 the current interrupt service routines are executed every half cycle. After the shutdown flag has been set, a shutdown procedure is executed in step 128 and return is made to step 121.

Figure 10A:
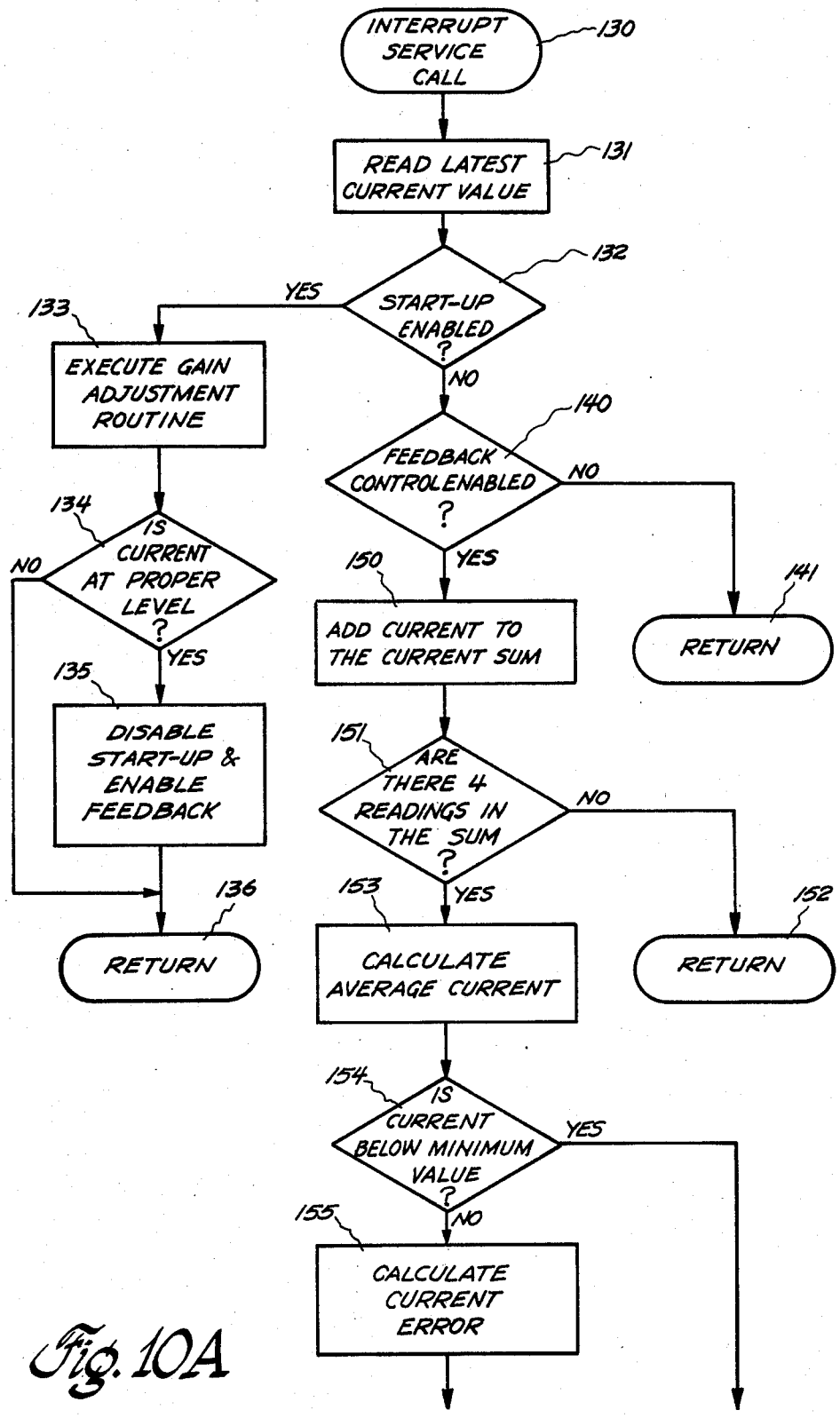
FIGS. 10A and 10B contain a flow diagram of the current control interrupt service routines used by the microprocessor of FIG. 8.
Figure 10B:
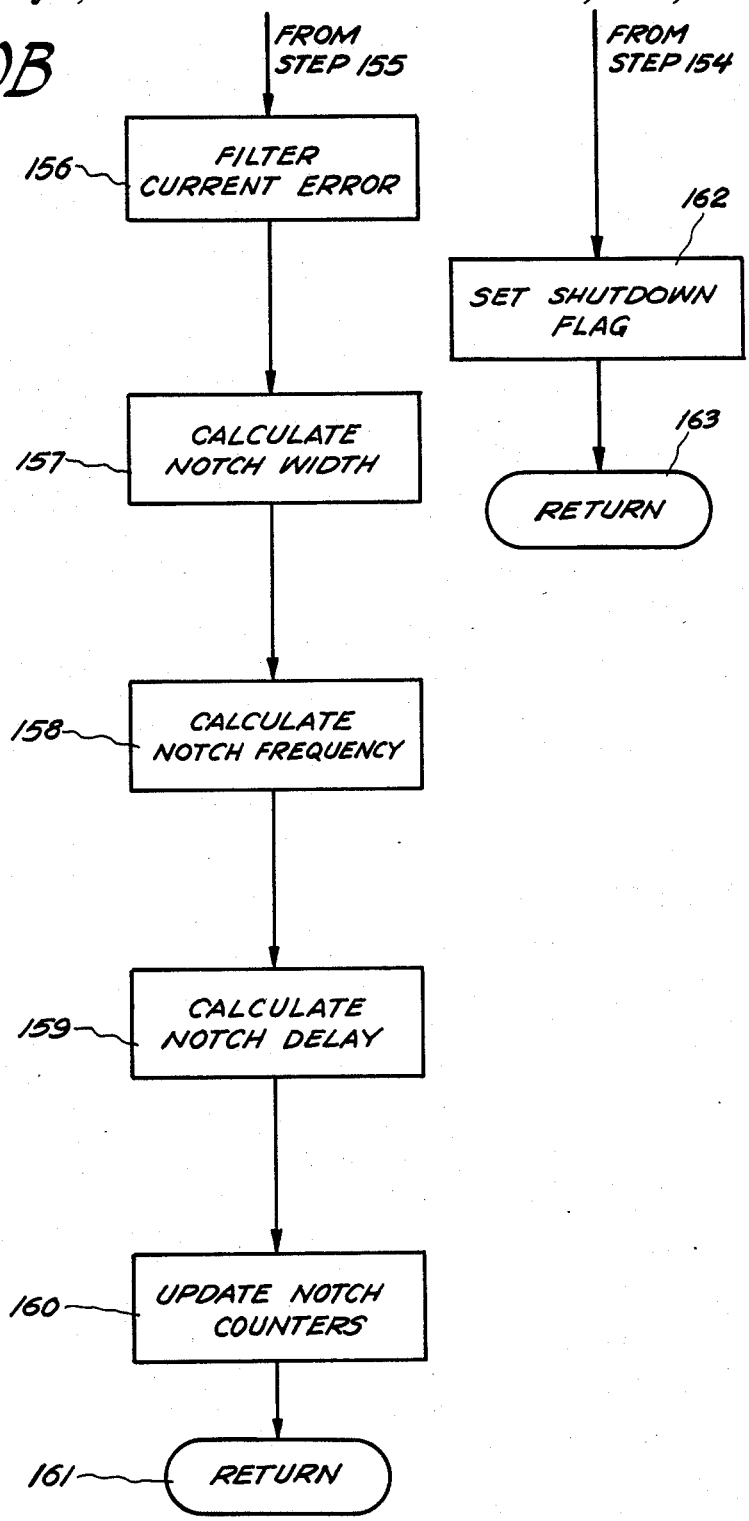

FIGS. 10A and 10B show a flow chart of the interrupt service routine executed each time a current zero is generated by NOR gate 111 of FIG. 8. The interrupt service call is made at step 130. The latest current integral value is read at step 131. A test is made at step 132 to determine whether start-up is enabled.

If start-up is enabled a branch is made to step 133 where a gain adjustment routine is executed. A test for proper current level is made at step 134. If current has not reached the proper level, than a branch is made to step 136 which is a return from the interrupt service call. If current has reached the proper level then start-up is disabled and feedback is enabled in step 135 followed by a return in step 136.

If it is determined that start-up is not enabled in step 132 then a branch is made to step 140 which is a test to determine if feedback control is enabled. If not, a return from the interrupt service call is made in step 141. If feedback control is enabled then the latest current integral value is added to a current sum in step 150. Step 151 tests whether there are four readings in the running total. If not, a return is made in step 152. If the current sum consists of four current integral values, then a current average is calculated in step 153. Step 154 tests whether the average current is below a minimum value. If it is, then a shutdown flag is set is in step 162 and a return is made in step 163. If the average current is greater than or equal to the minimum value, then the current error is calculated in step 155. In step 156 the current error is filtered relative to the previous change in the notch period. Notch width is calculated in step 157 and notch frequency is calculated in step 158. After calculating the notch delay in step 159, the notch counters are updated in step 160, followed by a return from the interrupt service call in step 161.

A complete listing of the software used by microprocessor 100 in the present invention is included following this detailed description. The system software consists of five integrated modules which include the main program, hardware initialization, current control, command input and system debug and diagnostic routines. The five modules provide for closed loop control of the system current. This feature was accomplished by sensing the system current and comparing it with an input control parameter, and then modifying the notch commands accordingly. The system preferably also uses an auto-calibration feature during start-up which is described in concurrently filed application Ser. No. 780,143.

The main program performs a system executive function. System variables including control variables, control flags and adjustable constants are declared. The majority of the system variables are declared public, which means that they may accessed by any of the other modules. Initialization of the variables is also accomplished within the main program. The main program also contains the system interrupt service routines.

The initialization portion of the main program performs a cold start on the system. All interrupts are disabled and system variables are initialized, followed by a call to the hardware initialization routine. After returning from the hardware initialization, an internal counter and timer is set up to generate an interrupt about every 65 milliseconds to activate the diagnostic software. The main program then enables the interrupts and loops until the current integrals reach a starting value. The main program then enters a delay loop of about 130 milliseconds before enabling the start-up gain adjustment routine.

The main program then enters an idle loop from which interrupts may be taken to the start-up routine or the feedback current control routines. The idle loop tests for the setting of the shutdown flag. If the shutdown flag is set then the shutdown procedure is executed followed by a restart.

The diagnostic interrupt service routine is called about every 65 milliseconds. It saves the contents of all the volatile registers on a stack. Register bank #2 is selected for the duration of the diagnostic interrupt service routine. A call to SYS_DIAG is made followed by a call to DIAGhd —OUT. The SYS_DIAG routine performs a reading of the command switches on the hexadecimal debug panel. Depending upon the status of the command switches, variables may be changed or viewed at the panel. The variables to be displayed are copied into storage locations which are accessed by the DIAG_OUT routine which takes the contents of the assigned storage and sends the information to the appropriate addresses of the displays. After returning from DIAG_OUT, the diagnostic interrupt service routine returns the contents of the volatile registers and returns to the location from which the interrupt service routine was called.

The current zero interrupt service routine activates the current control software of the system. This routine saves the contents of the accumulator and the program status word on the stack and selects register bank 1 for the duration of the routine. The latest current integral value from the system timing controller is read from the variable V_I_COUNT. A control flag B_START_ENABLE is checked for executing the start-up routine. Likewise, a flag B_FB_ENABLE is checked for executing the feedback routines. The start up routine, CHECK_SF will not be described in detail since it is described in concurrently filed application Ser. No. 780,143. However, the feedback control CURRENT_COMP routine is discussed below. The current zero interrupt service routine restores the values of the accumulator and the program status word before executing a return.

The current control routines are the heart of the feedback control system of the invention. The routines include a current error calculation, a digital error filter, notch parameter calculations and the updating of the system timing controller with the notch parameters.

The current integral value used in the remainder of the current control routine is an averaged value of four successive readings. This feature is used to damp the effect of erroneous current readings.

Upon entry into the CURRENT_COMP module, the microprocessor forces the output of the notch frequency counter to a low state. This must be done to guarantee the output state of the notch frequency counter. Then the latest current integral value is added into a variable V_I_SUM. A counter (V_SUM_CNT) is used to keep track of the number of readings in the sum. If the value of the counter is less then four, a jump to the end of the current control routines is executed. If the sum counter has reached the value of four, the counter is reloaded with zero and the current average is calculated. The average is stored in the variable V_I_AVG which is a 16-bit value.

The average current value (V_I_AVG) is checked to see if it has fallen below a minimum value. If it has, the control flag B_SHUT_ENABLE is set and a jump to the end of the control routines is executed. If the current is at an acceptable level, then the current error calculation routine is executed.

In the current error routine, the reference current value (V_I_CMMD) is subtracted from the average current (V_I_AVG). The result is clamped to an 8 bit value as an absolute value (V_I_ERR) plus a sign bit (B_ERR_SIGN).

The current error is passed through a digital filter which performs a damping function upon the system response. The filter has two gain values A and B, where $A+B=1$. The variable A_BETA_GAIN corresponds to the B gain value which is an adjustable constant which may be tuned to obtain optimal system performance. The equation for the error filter is as follows: $A \cdot D + B \cdot E = D'$, where D corresponds to the previous change in the current command, E corresponds to the current error and D' corresponds to the new delta in the current command. By increasing the value of A_BETA_GAIN, the effect of the latest current error becomes more significant and therefore reduces the damping effect of the filter. The resulting variable V_DELTA_I is an 8-bit value plus a sign bit which will be used to modify the notch variables.

The notch calculation routine calculates the width of the current notch. The V_DELTA_I value from the error filter routine is added to the notch command for the previous cycle (V_NTCH_CMMD). Since the value of V_DELTA_I is bipolar, the resulting change in the notch will reflect the sign bit of the error. After the new value of the notch has been calculated, two checks are made to determine if the new command is within limits. The first check will limit the maximum width of the notch. If the new value for the command is larger then the value of A_MAX_NTCH, the value of the command is replaced by that of A_MAX_NTCH. If the value of the notch command is found to be less than the maximum value, a second check is performed to insure that the notch command is not smaller than a minimum value. A similar substitution is made if the notch command is too small. The minimum value must be maintained to keep the controller hardware functioning. At the minimum notch width the pulse width is too narrow for the power electronics to respond and there is no effect on the current waveform.

The notch frequency calculation routine performs two functions. First, the calculation insures that the pulses within the notch are evenly distributed and all have the same width. Second, the calculation insures that there is an odd number of transitions so that the output state of the gate drive is at the same level before and after the notch. The base frequency for the notch pulses is about 1 Kz. The calculation uses the notch command V_NTCH_CMMD to generate the frequency command. The high byte of the notch command is tested to determine if it is even or odd. If the value is even it is decremented by one. This value is then divided back into the notch command value to generate the duration of each pulse.

The notch update routine simply selects the appropriate registers in the STC and loads them with the new values for the notch. After all of the new values have been sent, a test is made on the flag B_CMMD_ENABLE to determine if the command reference monitor is to be executed. If the flag is set a call is made to COMMAND_UPDATE. After this point a return to the current zero interrupt service routine is made.

The command update routine provides an interface between the user and the control. Under the present configuration, the routine looks at a variable V_CMMD_INPUT for the command input source which is accessed through the switch panel. The system is designed to provide 10 discrete light output values. A limiting check is done on the command input variable. If the value is greater than OAH then OAH is placed in the variable. The value is then used to index into a table of command reference values. A subtraction is then made between the value from the table and the latest reference command (V_I_CMMD). The resulting difference is then compared to an adjustable constant A_STEP_SIZE. If the difference is larger than the constant, then the value of the constant is used to calculate the next value for V_I_CMMD, else the difference is used. The new value of V_I_CMMD is then calculated by adding or subtracting the difference from the previous V_I_CMMD depending upon the sign of the difference. By employing the constant A_STEP_SIZE, a ramping effect is obtained between discrete light output settings.

The hardware initialization module is called by the start-up routine. During its execution, all registers in the AM9513 STC are initialized along with the gain of the D/A converter. The initial values for the STC are stored in a table STC1_INI_DAT. A register in the 8751 microprocessor is setup to index through the table. To initialize the STC, a Reset and Load All Counters command is sent. Once done, the Master Mode Register is initialized. At this point the remainder of the STC is initialized with the data from the table. Once all the counters have been sent their initial values, a Load All Counters command is sent again to shift in the data. The output state of the counters are then appropriately set and the counters are armed.

At the start of the routine the TXD bit of the microprocessor is set. This is done to initialize the output state of flip-flop 107. The bit is cleared just prior to the return from the hardware initialization routine.

Figure 11:
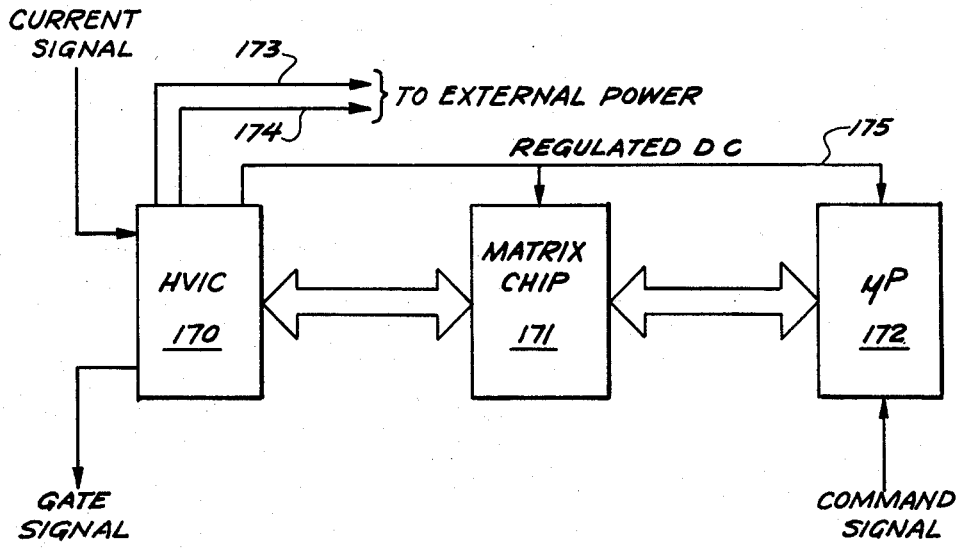
FIG. 11 is a block diagram of an embodiment of the present invention using customized integrated circuits.

Turning now to FIG. 11, a preferred embodiment for packaging the dimming control circuit of the invention includes custom integrated circuits. A custom high voltage integrated circuit (HVIC) 170 provides connection to the main switch via the gate signal and the current signal and to an external source of power, e.g. the AC power line or the voltage across the main switch. HVIC 170 is connected to a custom matrix chip 171 which is connected to a microprocessor 172. HVIC 170 and matrix chip 171 are customized to include the various components of the dimming control circuit previously discussed.

HVIC 170 includes a driver for translating the matrix chip gate drive signal to the IGT gate signal. The signal processing circuitry is included in HVIC 170 for supplying current zero signals and an instantaneous current signal to matrix chip 171. HVIC 170 also includes a power supply for providing regulated DC voltage to the dimming control circuit.

Matrix chip 171 implements the functions of D/A converter 103, VCO 104 and notch blanking AND gate 112 of FIG. 8. It also provides current zero signal processing in the manner of flip-flop 107, NOR gate 111 and STC 105 of FIG. 8. Matrix chip 171 further contains a current integral register and notch period and notch pulse registers, and may further contain an interface for receiving a light level command signal if this is not included in microprocessor 172. Logic circuits for combining various signals are also contained in matrix chip 171.

The registers of matrix chip 171 are under the control of microprocessor 172. Microprocessor 172 includes a clock, a stored program and data memory, and may be similar to microprocessor 100 described above. These functions may be peripheral to or incorporated within a microprocessor chip.

The foregoing has described an electronic control and a control method for dimming fluorescent lamps. Closed-loop feedback of ballast input current provides a dimming system which is insensitive to voltage fluctuations and DC offsets. The retrofitable dimming system provides low energy consumption and low cost.

While preferred embodiments of the present invention have been shown and described herein, it will be obvious that such embodiments are provided by way of example only. Numerous variations, changes and substitutions will occur to those skilled in the art without departing from the spirit of the invention. Accordingly, it is intended that the invention be limited only by the scope of the appended claims.

What is claimed is:

1. A method for operating a dimming system connected to a fluorescent lighting system, said fluorescent lighting system including a ballast, fluorescent lamps and an AC source, said dimming system including a switch connected in series with said ballast and a dimming control circuit for controlling said switch, said dimming control circuit adapted to turn on and off said switch at a high frequency during a notch period within each half-cycle of current supplied to said ballast by said AC source and adapted to turn on said switch during the portions of each half-cycle outside of said notch period, the location and duration of said notch period being controlled by said dimming control circuit to provide a variable light output from said lighting system in response to a level command, said method comprising the steps of:

(1) taking a plurality of current measurements, each measurement representing at least a portion of the current flowing to said ballast during a predetermined time period;

(2) averaging said plurality of measurements;

(3) calculating the error between said average and a command current reference corresponding to said level command; and (4) altering said notch period to reduce said error.

2. The method of claim 1 wherein said predetermined time period corresponds to a half-cycle of the current supplied by said AC source, and wherein each of said current measurements is the integral of current flowing during the portions of a respective half-cycle outside of said notch period.

3. The method of claim 2 wherein said plurality of current measurements are obtained from four consecutive half-cycles.

4. The method of claim 1 wherein steps 1–4 are continuously repeated.

5. The method of claim 4 further comprising the step of periodically checking for a change in said level command.

6. The method of claim 5 further comprising the steps of:

(A) finding the difference between the latest command current reference and the command current reference corresponding to said light level command;

(B) comparing the difference from step A to a predetermined step size constant; and (C) if said difference is greater than said constant, then altering said command current reference by an amount equal to said constant, else altering said command current reference by an amount equal to said difference;

whereby a ramping effect of the light output results whenever shifting between discrete light output settings of said level command.

7. The method of claim 4, after said error calculating step, further comprising the step of:

digitally filtering said error relative to the previous alteration in said notch period, said filtered error providing the amount by which said notch period is to be altered.

8. The method of claim. 7 wherein said error is filtered according to the equation $(A \cdot D)+(B \cdot E)=D'$, where D is the previous alteration in said notch period;

E is said error;

D' is the new notch period alteration; and

A and B are gain values whose sum is unity.

9. The method of claim 8 wherein A has a value of 0.75 and B has a value of 0.25.

10. The method of claim 1 wherein said predetermined time period corresponds to a half-cycle of the current supplied by said AC source, said method further comprising the steps of:

sensing alternate zero crossings of said current; and electronically counting to determine the midpoints between said sensed alternate zero crossings;

whereby the timing of said half-cycles is established without errors caused by DC offset voltages.

11. The method of claim 1, after said averaging step, further comprising the step of shutting down said dimming system if said average is below a predetermined value.

12. A dimming control circuit in a fluorescent lamp dimming system, said dimming system being adapted to be connected to a fluorescent lighting system including a ballast, fluorescent lamps and an AC source, said dimming system including a switch for connecting in series with said ballast, said switch adapted to turn on and off at a high frequency during a notch period within each half-cycle of current supplied to said ballast by said AC source and adapted to turn on during the portions of each half-cycle outside of said notch period, said dimming control circuit comprising:

signal processing means for coupling to said switch, said signal processing means providing a first output signal proportional to the instantaneous current flowing through said switch from said AC source to said ballast and a second output signal for indicating zero crossings of said instantaneous current;

integrating means coupled to said signal processing means for integrating said first output signal to provide a current integral, the timing of the integration being provided according to said second output signal;

comparing means coupled to said integrating means for comparing said current integral to a command current reference and providing an error value;

timing means coupled to said signal processing means for receiving said second output signal and adapted to be coupled to said switch, said timing means for establishing said notch period and the high frequency switching of said switch during said notch period; and logic means coupled to said signal processing means, said comparing means and said timing means, said logic means adapted to receive a light level command signal, said logic means providing said command current reference to said comparison means based on said light level command signal, and said logic means providing counting values to said timing means based on said command current reference and said error value.

13. The dimming control circuit of claim 12 wherein said comparing means computes an average error value over four consecutive half-cycles.

14. The dimming control circuit of claim 12 wherein said signal processing means indicates alternate zero crossings via said second output signal, and wherein said timing means further includes means for determining the midpoints between said alternate zero crossings.

15. The dimming control circuit of claim 12 further comprising error filtering means coupled to said comparing means and to said logic means for filtering said error value relative to the previously filtered error value.

16. The dimming control circuit of claim 15 further comprising notch blanking means coupled to said signal processing means, said integrating means and said timing means, said notch blanking means reducing the input signal to said integrating means to zero during said notch period.

17. The dimming control circuit of claim 12 further comprising notch blanking means coupled to said signal processing means, said integrating means and said timing means, said notch blanking means reducing the input signal to said integrating means to zero during said notch period.

18. The dimming control circuit of claim 12 further comprising driving means for coupling between said timing means and said switch for turning on and off said switch in accordance with outputs of said digital counters.

19. The dimming control circuit of claim 12 further comprising scaling means coupled to said signal processing means, said integrating means and said logic means for normalizing said first output signal of said signal processing means.

20. A fluorescent lamp dimming system for connecting to a fluorescent lighting system, said lighting system including a ballast, fluorescent lamps and an AC source, said timming system comprising:

a switch for connecting in series with said ballast, said switch adapted to turn on and off at a high frequency during a notch period within each half-cycle of current supplied to said ballast by said AC source and adapted to turn on during the portions of each half-cycle outside of said notch period;

signal processing means coupled to said switch, said signal processing means providing a first output signal proportional to the instantaneous current flowing through said switch from said AC source to said ballast and a second output signal for indicating zero crossings of said instantaneous current;

integrating means coupled to said signal processing means for integrating said first output signal to provide a current integral, the timing of the integration being provided according to said second output signal;

comparing means coupled to said integrating means for comparing said current integral to a command current reference and providing an error value;

timing means coupled to said signal processing means for receiving said second output signal and adapted to be coupled to said switch, said timing means including digital counters for establishing said notch period and the high frequency switching of said switch during said notch period; and logic means coupled to said signal processing means, said comparing means and said timing means, said logic means adapted to receive a light level command signal, said logic means providing said command current reference to said comparison means based on said light level command signal, and said logic means providing counting values to said digital counters based on said command current reference and said error value.

21. The dimming system of claim 20 wherein said comparing means is adapted to compute an average error value over four consecutive half-cycles.

22. The dimming system of claim 20 wherein said signal processing means indicates alternate zero crossings via said second output signal, and wherein said timing means further includes a digital counter for determining the midpoints between said alternate zero crossings.

23. The dimming system of claim 20 further comprising error filtering means coupled to said comparing means and to said logic means for filtering said error value relative to the previous filtered error value.

24. The dimming system of claim 23 further comprising notch blanking means coupled to said signal processing means, to said integrating means and to said timing means, said notch blanking means reducing the input signal to said integrating means to zero during said notch period.

25. The dimming system of claim 20 further comprising notch blanking means coupled to said signal processing means, said integrating means and said timing means, said notch blanking means reducing the input signal to said integrating means to zero during said notch period.

26. The dimming system of claim 20 further comprising driving means coupled between said timing means and said switch for turning on and off said switch in accordance with outputs of said digital counters.

27. The dimming system of claim 20 further comprising scaling means coupled to said signal processing means, to said integrating means and to said logic means, for normalizing said first output signal of said signal processing means.

28. The dimming system of claim 20 further comprising clamping means adapted to be connected in parallel with said ballast for clamping the voltage across said ballast to a predetermined value.

29. A fluorescent lamp dimming system for connecting to a fluorescent lighting system, said lighting system including a ballast, fluorescent lamps and an AC source, said dimming system comprising:

microprocessor means for controlling the operation of said dimming system, said microprocessor means including a clock, a stored program and data memory, said microprocessor means being responsive to an interrupt;

a data bus connected to said microprocessor means;

an address bus connected to said microprocessor means;

a timing controller connected to said data bus and to said address bus, and coupled to said microprocessor means, said timing controller including a notch digital counter and a pulse digital counter, said notch digital counter adapted to generate a notch period, the output of said notch digital counter having a first output state during said notch period and having a second output state outside of said notch period, said pulse digital counter adapted to generate high frequency pulses during said notch period, the counting values of said notch and pulse digital counters being loaded by said microprocessor means via said data bus and said address bus; and interface means connected to said microprocessor means for receiving an externally supplied light level command and for providing said command to said microprocessor means.

30. The dimming system of claim 29 further comprising a first logic gate coupled to said timing controller for combining the outputs of said notch and pulse digital counters to generate a gate signal.

31. The dimming system of claim 30 further comprising:

current zero detector means adapted to be coupled to said lighting system for generating a pulse signal at every other zero crossing of the low frequency component of current from said AC source;

a zero-crossing digital counter in said timing controller for generating a pulse signal at alternate zero crossings; and a second logic gate for combining the pulse signals from said current zero detector means and said zero-crossing digital counter, the output of said second logic gate being connected to said microprocessor means so as to generate an interrupt in said microprocessor means at every zero crossing pulse from said second logic gate.

32. The dimming system of claim 31 further comprising:

current converting means adapted to be coupled to said lighting system for generating an output signal having an instantaneous frequency proportional to the instantaneous magnitude of the current flowing to said ballast;

an integral digital counter in said timing controller coupled to said current converting means for generating the integral of said current; and a third logic gate coupling the output of said current converting means to said integral digital counter, said third logic gate being connected to the output of said notch digital counter, said third logic gate transmitting said current converting means output signal outside of said notch period.

33. The dimming system of claim 31 wherein said current zero detector means is comprised of a flip-flop for generating said pulse signal at its inverted output and wherein said timing controller includes an inhibit digital counter for setting said flip-flop between alternate zero crossings.

34. The dimming system of claim 32 further comprising a switch for connecting in series with said ballast, said switch adapted to be turned on and off in accordance with said gate signal.

35. The dimming system of claim 34 further comprising opto-coupling means for coupling said gate signal to said switch.

36. The dimming system of claim 35 further comprising a clamp switch for connecting in parallel with said ballast.

37. A fluorescent lamp dimming system for connecting to a fluorescent lighting system, said lighting system including a ballast, fluorescent lamps and an AC source, said dimming system comprising:

a switch for connecting in series with said ballast, said switch adapted to turn on and off at a high frequency during a notch period within each half-cycle of current supplied to said ballast by said AC source and adapted to turn on during the portions of each half-cycle outside of said notch period;

a high voltage integrated circuit connected to said switch including a driver circuit for connecting to the control electrode of said switch, detector means for generating current zero signals, and current means for generating a current signal having a magnitude proportional to the instantaneous current flowing in said switch;

a matrix chip connected to said high voltage integrated circuit including integrating means for integrating said current signal, notch timing means for generating said notch period, pulse means for generating pulses at said high frequency during said notch period, and logic gate means for combining the outputs of said notch timing means and said pulse means to generate a gate signal for coupling to said drive circuit; and a microprocessor connected to said matrix chip for controlling said matrix chip in accordance with a desired light level of said fluorescent lamps.

38. The dimming system of claim 37 wherein said switch is comprised of an IGT.

39. The dimming system of claim 37 further comprising clamping means adapted to be connected in parallel with said ballast for clamping the voltage across said ballast to a predetermined value.

* * * * *